US005836252A

United States Patent [19]

Roick

[11] Patent Number: 5,836,252

[45] Date of Patent: Nov. 17, 1998

[54] RAIL BRAKE ELEMENT

[75] Inventor: Reinhard Roick, Burks Falls, Canada

[73] Assignee: A. Rawie GmbH & Co., Osnabruck, Germany

[21] Appl. No.: 860,318

[22] PCT Filed: Jan. 26, 1996

[86] PCT No.: PCT/EP96/00321

§ 371 Date: Feb. 24, 1998

§ 102(e) Date: Feb. 24, 1998

[87] PCT Pub. No.: WO96/26855

PCT Pub. Date: Sep. 6, 1996

[30] Foreign Application Priority Data

Feb. 28, 1995 [DE] Germany ..... 195 07 000.3

[51] Int. Cl.[6] ..... B61K 7/00

[52] U.S. Cl. ..... 104/259; 104/258

[58] Field of Search ..... 104/249, 254, 104/258, 259; 188/33, 34, 35, 36, 41, 43, 62, 63

[56] References Cited

U.S. PATENT DOCUMENTS

| | | | |
|---|---|---|---|
| 2,762,314 | 9/1956 | Hayes . | |
| 2,835,207 | 5/1958 | Hayes | 104/258 |
| 2,900,923 | 8/1959 | Hayes | 104/258 |
| 3,230,898 | 1/1966 | Skelton | 104/259 |

FOREIGN PATENT DOCUMENTS

| | | |
|---|---|---|
| 834572 | 2/1952 | Germany . |
| 2453223 | 11/1984 | Germany . |
| 3422230 | 12/1985 | Germany . |
| 34 43 480 | 4/1987 | Germany . |
| 2 060 095 | 4/1981 | United Kingdom . |

*Primary Examiner*—Mark Tuan Le
*Attorney, Agent, or Firm*—Vidas, Arrett & Steinkraus, P.A.

[57] ABSTRACT

The invention relates to a rail brake element, in particular for use in rail brake buffer blocks, comprising a pair of clamping plates extending about a rail head from each side and supported against its top surface, which clamping plates are clamped against the rail head by a clamping device including a clamping bolt and a spring assembly, and include at its portion below the rail head a brake lining portion of suitable rigid friction material for engagement with the rail head, wherein the brake lining layer engages the rail head by means of a raised portion of wear material having a static friction coefficient smaller than that of the brake lining layer.

5 Claims, 2 Drawing Sheets

RAIL BRAKE ELEMENT

The invention relates to a rail brake element, in particular in connection with rail brake buffer blocks.

A rail brake element of the above-identified type has become known from German 24 53 223. The clamping plates which are of an approximately C-shaped cross-section are pressed together above the rail head by means of clamping bolts. In the lower area the clamping plates include angular friction elements which are made of a suitable friction material such as bronze. The friction elements engage the bottom side and the lateral surfaces of the rail head. A so-called lining piece is supported against the rail head, which lining piece is also made of friction material and has at its upper side tapered surfaces which are engaged by the upper legs of the clamping plates. When the clamping bolts are subjected to tension forces, compression and tension forces are exerted upon the friction elements by a wedge action such that a corresponding friction force will be generated at the rail head.

Modifications of such a brake element have become known from German 834 572 or German 34 22 230.

Apart from the friction coefficient the brake action of such a rail brake element depends on the force which urges the friction elements against the rail head. This force is applied via the clamping bolt, with a double spring ring being disposed between the clamping bolt and a clamping plate. The only possibility to preset the urging force is to measure the torque for tightening the clamping bolt. However, there are no defined relationships between the measured torque and the actual urging force because the measured torque depends also on other parameters such as the friction at the clamping bolt threads or the friction between the bolt head and the spring, etc. When there will be wear of the friction element, the reduced stroke will be compensated by the helical spring. If the helical spring exhibits an unfavorable force-displacement-relationship, which is the case normally with the used helical springs, wear will result in a significantly reduced urging force.

The actual braking effect by the rail brake element is obtained by displacing the rail brake element along the rail head, for example by a buffer block which either stands upon the rails relatively loosely or is integrated in the rail brake element. However, before this will occur, stationary friction will have to be overcome, with stationary friction theoretically being at least twice as large as sliding friction, however, in practice may be much higher due to corrosion of the rail and braking parts of the rail brake element. During the initial impact phase the rail brake element acts like a rigid barrier which begins to move only after the stationary friction has been overcome. This will cause a substantial shock for the oncoming vehicle. If a plurality of rail brake elements are disposed one after the other in abutting relationship, this will result in an excessive, unacceptable value of the described stationary friction. This is why it is common in practice to arrange the rail brake elements in spaced relationship so that the stationary friction of the individual rail brake elements will be overcome one after the other during a braking operation.

GB-A 2 060 095 discloses a rail brake element wherein clamping plates provided with friction material at its lower faces extend below a rail head and have their upper portion engage an elongated retaining element. Bolts extending therethrough connect the opposed clamping plates to the retaining element therebetween. Spaced recesses of the retaining element receive Belleville spring assemblies biased via compression disks by bolts threaded into the retaining element. The Belleville spring assemblies act upon an elongated element below the retaining element which is urged in this manner against the associated rail head. The elongated element or, respectively, a corresponding insert in the elongated element is made of suitable friction material.

The problem to be solved by the invention is to provide, in particular in connection with rail brake buffer blocks, a rail brake element, which can be used for a great varity of rail types without any modification of its dimension and which allows for setting defined brake forces.

This problem is solved by the features of the present invention.

In the device of the invention the clamping device is supported against the top side of the rail head via pads of friction material and exerts a tension force upon the clamping plates. As a result the urging force for the brake lining layer is not produced by a wedge effect as in the prior art rail brake elements, but exclusively by a tension force at the clamping plates. The tension force will be produced by clamping bolts which act upon the pads which rest upon the rail head and are made of friction material. Adjustment of the clamping bolt results in proportional adjustment of the clamping plates and accordingly of the urging force exerted by the brake lining layer upon the rail head. This allows to provide for a simple relationship between the urging force and the pressure at the rail head in order to set the desired brake force. While there will be an elongation of the clamping plates, when substantial tension forces are applied, such an elongation is, however, also of a linear nature in the resilient range so that the linear relationship between clamping bolt adjustment and the urging force at the rail head is not affected.

Furthermore, the clamping device of the present invention may be designed such that it is usable with any type of rails.

The pads are disposed in recesses of the lining ledge, and a compression spring is disposed between the clamping bolt and the pad. Wear of the brake lining results in a spring displacement. If the compression spring, according to the invention, is comprised of a Belleville spring or a Belleville spring assembly, an advantageous force displacement relationship will result. More or less wear, accordingly, will result only in a very small reduction of the urging force of the brake lining layer at the rail head.

The invention furthermore will have the advantage that the urging force may be measured over the distance for which the clamping bolt moves. According to the invention this is realized by the clamping bolt being hollow and an indicator rod extending through the clamping bolt to the pad. A securing means may be positioned between the clamping bolt head and the indicator rod to prevent the indicator rod from dropping through the clamping bolt. The relative positions of the indicator rod and the clamping bolt are a measure for the distance for which the clamping bolt moves when it is being tightened. Furthermore it may be used to indicate wear. When, for example, after initial tightening of the clamping bolt the position of the indicator rod is being marked and the indicator rod will indicate a changed lowered position after brake operation, then the spacing between the marked position and the lowered position is a measure for wear of the brake lining layer.

Securing the indicator rod in the clamping bolt prevents the indicator rod from dropping through the clamping bolt before assembly. A press-fit between the indicator rod and the pad enables to retain the pad and the clamping bolt before final assembly.

In the device of the invention the lining ledge, the pad, the Belleville spring assembly and the clamping bolt including the indicator rod may form a premounted unit which may be mounted to the rail head by means of the clamping plates. As already mentioned, the indicator rod ensures that the pad is retained in the unit by its connection to the indicator rod.

It is to be noted that when the rail brake element is of elongated shape the lining ledge may extend along the length of the clamping plates and retains a plurality of pads in spaced relationship within recesses in order to provide for a uniform pressure between the brake lining layer and the rail head along the length of the rail brake element.

In a further embodiment of the invention the face of the brake ledge facing the rail head is of a convex arcuate cross-section. The convex arcuate shape of the brake ledge is advantageous in that the brake ledge engages the rail head over a defined surface, i.e. only at the bottom side. This also ensures defined brake conditions.

In the following the invention will be explained in more detail with reference to drawings.

Figure 2:
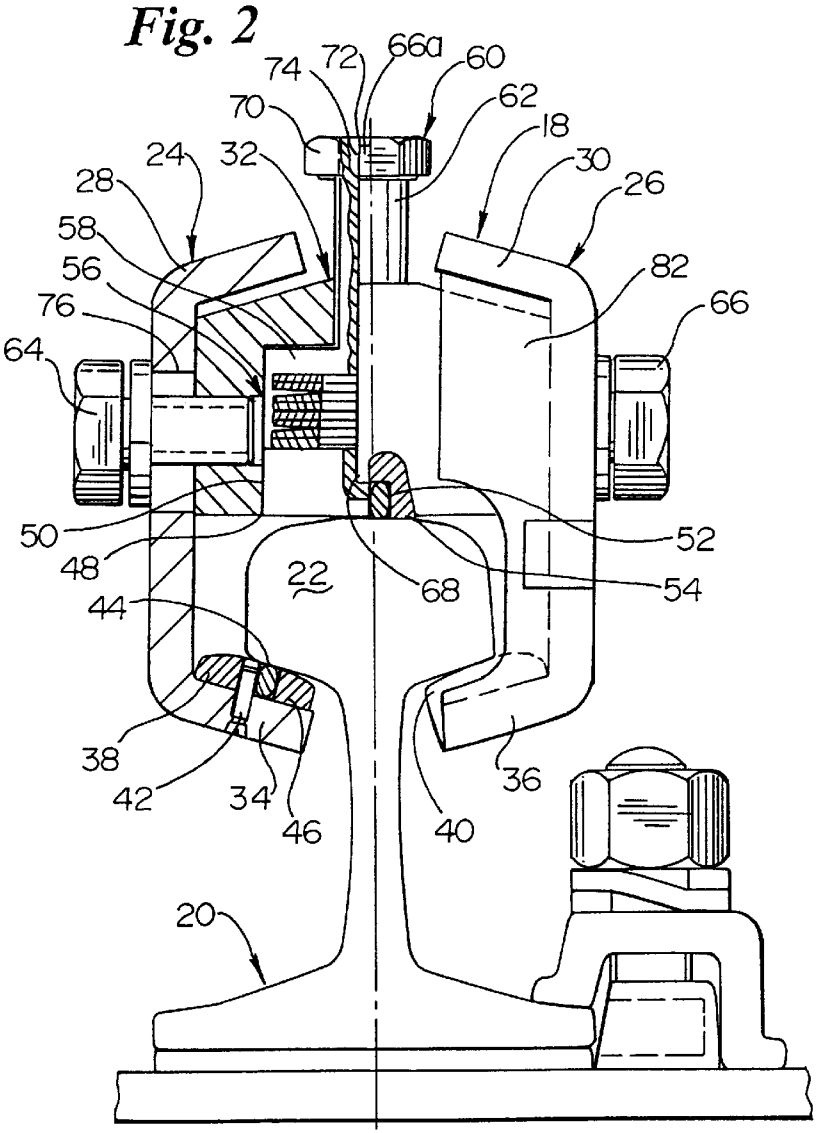
FIG. 2 shows the rail brake element of FIG. 1, partially in cross-section, for a third type of rail.
Figure 1:
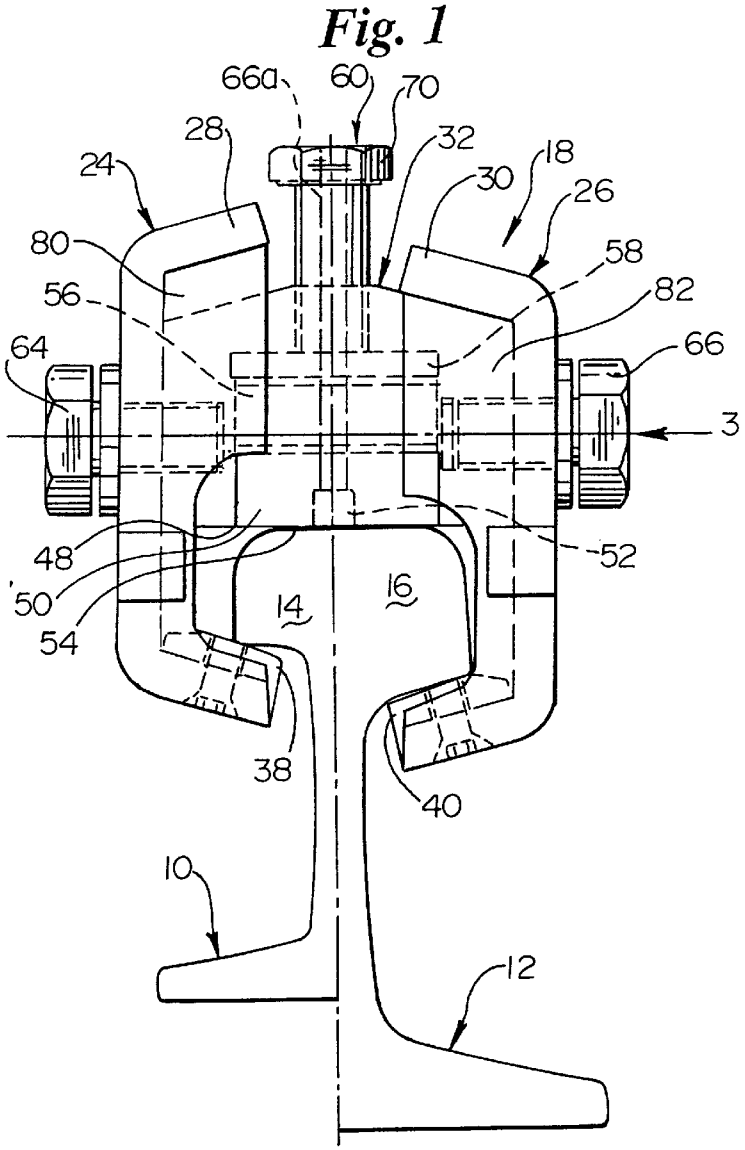
FIG. 1 shows an end elevation of a rail brake element of the invention for a pair of different rails.
Figure 3:
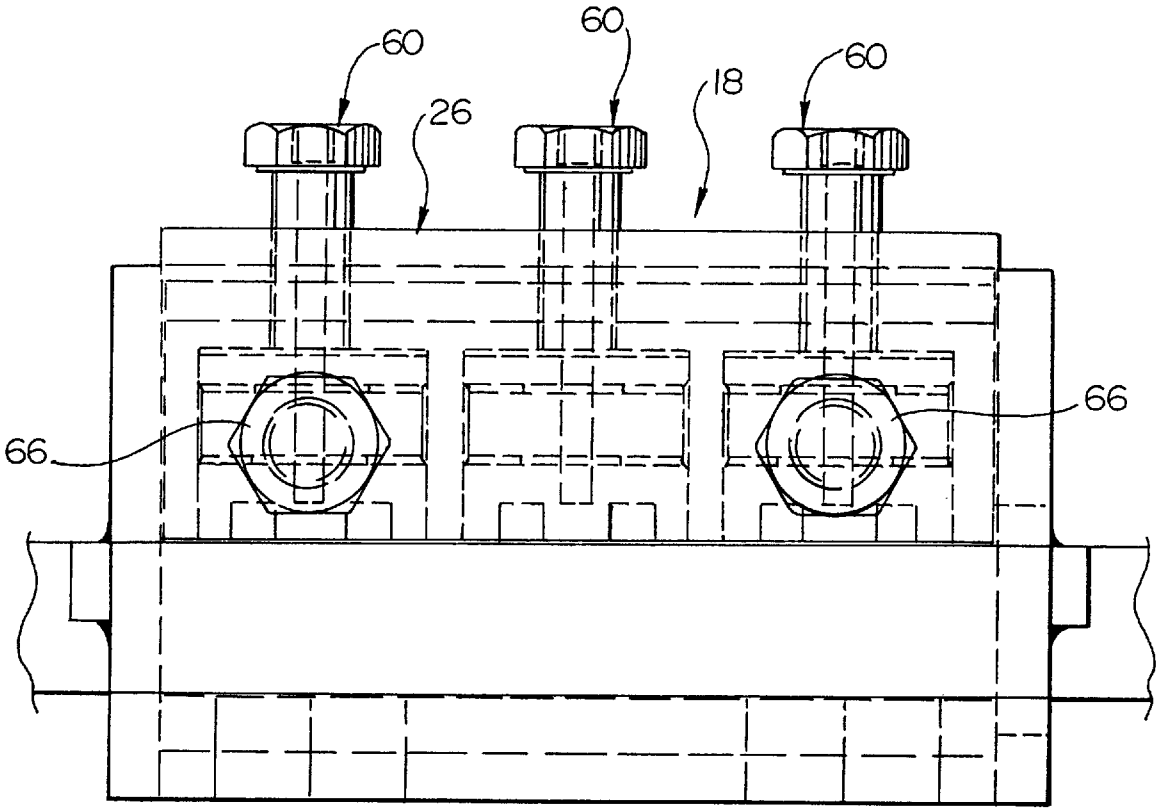
FIG. 3 is a side elevation of the rail brake element of FIG. 1 in the direction of arrow 3.

FIG. 1 shows, in cross-section, a first rail 10 (left-hand side) and a second rail 12 (right-hand side) including a rail head 14 and 16, respectively. Identical rail brake elements 18 are provided for both rail heads 14, 16. FIG. 2 shows a third rail 20 having a rail head 22 for which an identical rail brake element 18 is used. Accordingly it is usable universally. It includes on opposite sides of the rail head clamping plates 24, 26 which are of an approximately C-shaped cross-section and terminate at their ends in inwards extending flanges 80, 82. Upper legs 28 and 30 of the clamping plates 24 and 26 extend above a lining ledge 32 which has roof surfaces at its upper side. Brake lining layers 38 and 40 forming brake ledges are mounted to the lower legs 34, 36 of the clamping plates 24, 26 by bolts as indicated at 42. In FIG. 1 the bolts are shown by dotted lines. As shown the brake ledges which are made of a suitable friction material such as bronze are of convex arcuate shape at their outsides and engage only the bottom side of rail head 14, 16 and 22, respectively.

As may be seen in FIG. 2 on the left-hand side, the ledges of the brake lining layers 38, 40 include bores which receive block-like wear portions forming raised portions. The wear portions 44 which are of circular cross-section include at their sides facing the clamping plate 24 a flange 46 which is received in the corresponding recess or counterbore of the brake ledge. As a result the wear portions 4 are securely retained in the brake ledge. Each brake ledge may comprise a row of such wear portions 44 spaced in the longitudinal direction. They are made of a suitable plastic material such as polyamide which exhibits a relatively high pressure compression resistence. They project only slightly above the arcuate top side of the brake ledges (see FIG. 1 and right-hand side of FIG. 2), provide, however, the only contact surface at the bottom side or the rail head 14, 16 or 22, respectively.

The lining ledge 32 extending along the length of the clamping plates 24, 26 has at its bottom side three spaced circular recesses 48 which receive cylindrical pads 50. They are made of suitable friction material such as bronze. Block-like wear portions 52 of a suitable compression resistant plastics material such as polyamide are inserted into the bottom side of the pads 50 and are retained therein by a press-fit. Outwardly extending flanges forming raised portion provide for the only contact surface between the pads 50 and the rail head 14. 16 and 22, respectively.

A compression spring 56 and a compression disk 58 forming a Belleville spring assembly are received in the recesses 48 above the pads 50. Supported against the compression disk 58 is a clamping bolt 60 the shaft 62 of which is received in a threaded bore of the lining ledge 32. The clamping bolt 60 exerts a pressure force upon the pad 50 via the compression disk 58. Since the lining ledge 32 is connected to the clamping plates 24, 26 via bolts 64 and 66, respectively, a tension force is exerted upon the latter, which causes the brake ledges to exert an urging force against the bottom side of the rail head 14, 18 or 22, respectively.

The clamping bolts 60 are hollow and receive an indicator rod **66*a* which is received in a bore of the pad 50 by a press-fit at the lower end at 68. In the area of the head 70 of the clamping bolt 60 securing means 72 ensure that the indicator rod 66*a* cannot drop through the clamping bolt 60. The securing means 72 comprises a resilient ring or the like which contacts a shoulder 74 of the clamping bolt 60** when it is being moved downwards for a predetermined distance.

The shafts of the threaded bolts 64, 66 extend through over-dimensioned apertures 76 of the clamping plates 24, 26. The lining ledge 32, the clamping bolt 60, the compression disk 58, the Belleville spring assembly and the pads 50 form a unit premounted before the rail brake element 18 is mounted to the rail head 14, 16, 22. The described unit will be positioned upon the rail head, and thereafter the clamping plates 24, 26 are mounted thereto by means of the bolts 64, 66. Tightening of the clamping bolts 60 as described results in an urging force being exerted upon the pads 50 and the brake ledges, with the distance for which the clamping bolt 60 has moved being a measure for such a force. This distance may be measured now by the indicator rod which rests upon the pad 50.

When a braking operation will occur in that for example a rail brake buffer block moved by a vehicle is urged on one side against the clamping plates 24, 26, it is necessary initially to overcome the stationary friction. The latter is determined exclusively by the block-like wear portions. Since these exhibit a very small friction coefficient, the impact force for starting the rail brake element 18 to move is relatively small. A small friction distance, however, is sufficient for the raised portions 44, 54 of the wear portions to wear off so that the brake ledges and, respectively, the pad 50 will frictionally cooperate with the rail head 14, 16 or 22, respectively.

After such a brake operation it is necessary to exchange the wear elements.

I claim:

1. A rail brake element, for use in rail brake buffer blocks, comprising a pair of clamping plates extending about a rail head from each side, which clamping plates include at its portion below the rail head a brake lining portion of suitable rigid friction material for engagement with the rail head, a retaining element disposed between the clamping plates and connected to the latter by at least one bolt, which retaining element has at its lower side facing the rail head a plurality of spaced recesses each receiving a spring assembly which is biased by a bolt in the retaining element for urging an element of friction material against the upper face of the rail head so as to exert a tension force upon the clamping plates, characterized in that the retaining element is a lining ledge (32) receiving in said spaced recesses (54) cylindrical pads (50) of friction material, and in that the clamping bolt (60) is hollow and an indicator of rod **(66*a*) extends through the clamping bolt (60) to the pad (50)**.

2. A rail brake element according to claim 1, characterized in that the compression spring (56) comprises a Belleville spring assembly.

3. A rail brake element according to claim 1, characterized in that a securing means (72) is provided between a bolt head (70) of the clamping bolt (60) and the indicator rod **(66*a*) for preventing the indicator rod (66*a*) from dropping through the clamping bolt (60)**.

4. A rail brake element according to claim 1, characterized in that the indicator rod **(66*a*) is press-fitted into a bore of the pad (50)**.

5. A rail brake element according to claim 1, characterized in that the lining ledge (32) is connected to the clamping plates (24,26) by said at least one bolt including threaded bolts (64,66) and apertures (76) are provided in the clamping plates (24,26) for receiving the threaded bolts (64,66), each said aperture (76) having a diameter in excess of a diameter of bolt shafts of said threaded bolts (64,66).

* * * * *